United States Patent [19]

Gendron

[11] 4,190,161

[45] Feb. 26, 1980

[54] COMPARTMENTED ENVELOPE

[75] Inventor: Wilfred H. Gendron, Wilbraham, Mass.

[73] Assignee: Westvaco Corporation, New York, N.Y.

[21] Appl. No.: 964,709

[22] Filed: Nov. 29, 1978

Related U.S. Application Data

[63] Continuation-in-part of Ser. No. 868,875, Jan. 12, 1978, abandoned.

[51] Int. Cl.[2] ..... B65D 27/34; B65D 27/04; B65D 27/08; B65D 27/16

[52] U.S. Cl. ..... 206/620; 229/71; 229/72; 229/80

[58] Field of Search ..... 229/71, 72, 80; 206/610, 620, 629

[56] References Cited

U.S. PATENT DOCUMENTS

| | | | |
|---|---|---|---|
| 1,601,318 | 9/1926 | Overly | 229/71 |
| 1,858,277 | 5/1932 | Overly | 299/71 |
| 1,945,648 | 2/1934 | Lindgren | 229/80 |
| 1,964,595 | 6/1934 | Overly | 229/71 |
| 2,209,601 | 7/1940 | Heywood | 229/80 X |
| 2,887,327 | 5/1959 | Tucker | 229/72 X |
| 2,944,728 | 7/1960 | Whitman | 229/80 |
| 2,956,725 | 10/1960 | Landry | 229/72 |
| 3,116,010 | 12/1963 | Stevenson | 229/72 |
| 3,140,817 | 7/1964 | Fitzgerald | 229/72 |
| 3,140,817 | 7/1964 | Fitzgerald | 229/72 |
| 4,129,214 | 12/1978 | Gendron | 229/72 |

*Primary Examiner*—Stephen P. Garbe

[57] ABSTRACT

A compartmented envelope is disclosed which includes two compartments front-to-back formed by non-overlapping elongated end closure flaps. The front compartment includes a window behind which a preaddressed item might be placed and the envelope is arranged so that the window compartment is in front of the envelope stuffer when the preaddressed item is stuffed. The envelope panels are preapplied with a pressure sensitive adhesive that will only adhere to itself in a pattern so that items smaller than the envelope itself can be inserted and locked in place within the front compartment while the second compartment is available for larger more bulky items. In other embodiments, the envelope includes an unsecured end closure flap that may be opened for postal inspection when the envelope is carrying both first and third class matter, and/or a means for gaining access to one compartment independently of the other.

4 Claims, 8 Drawing Figures

COMPARTMENTED ENVELOPE

CROSS REFERENCE TO RELATED PATENT APPLICATIONS

This application is a continuation-in-part of applicant's copending application Ser. No. 868,875, filed Jan. 12, 1978, now abandoned and also entitled COMPARTMENTED ENVELOPE.

BACKGROUND OF INVENTION

Compartmented envelopes are well known in the art. They are generally used for mailing two different items or sets of items within the same envelope. For instance, banks use compartmented envelopes for mailing canceled checks and bank statements to their customers. Moreover, such envelopes usually include a window for one of the compartments whereby a preaddressed item can be accomodated thereby obviating the need to address the envelopes either before or after stuffing. In this regard, particular care must be exercised when a preaddressed item smaller than the envelope itself is inserted to insure that the address lines up with and stays behind the window. Compartmented envelopes are also useful for incorporating both first and third class matter together where a suitable opening is incorporated in the envelope structure to permit postal inspection.

The following prior art patents are believed to be exemplary of the type of envelope disclosed herein.

U.S. Pat. No. 2,200,099 Prentice
U.S. Pat. No. 2,944,728 Whitman
U.S. Pat. No. 3,136,476 Berkowitz
U.S. Pat. No. 3,140,817 Fitzgerald
U.S. Pat. No. 3,266,712 McCleneghan The patent to Prentice shows an envelope blank structure substantially as disclosed herein. The Prentice structure is used exclusively for incorporating both first and third class matter in the same envelope and does not encompass the herein disclosed two compartment structure, document locking feature and windowed construction. Meanwhile, the patents to Whitman, Berkowitz, Fitzgerald and McCleneghan each disclose compartmented envelopes, with means for providing a separate compartment for items smaller than the envelope itself, but with constructions that are more complex and which use more paper than the construction disclosed herein. Furthermore, none of the latter patents disclose an embodiment that may be used for both first and third class mail. Accordingly, the present invention distinguishes over the prior art because of its simplicity, multiple use capability and economical construction wherein a document locking feature is provided within the compartmented envelope structure with the aid of pressure sensitive adhesive applied to at least one of the elongated end closure flaps of the envelope.

SUMMARY OF INVENTION

The present invention relates to an improved envelope construction, and more specifically, to a compartmented envelope having a great deal of versatility. For instance, the envelope of the present invention includes a means for locking one item, that is smaller than the envelope itself, in a first compartment while leaving a second compartment free to accept other mailing matter having the same or larger dimensions than the first item. In addition, the envelope may also include a means for combining first class mail in one compartment and third class mail in another compartment.

In the preferred embodiment, the envelope is formed with two compartments front-to-back wherein one of the compartments includes a window. This construction provides the user with the opportunity of inserting a first pre-addressed label, statement or card in one compartment behind the window, with the second compartment being free to accept other mailing matter such as canceled checks, brochures or other advertising literature. The document locking feature of the present invention is provided in conjunction with the first compartment for use in the event that the pre-addressed item is smaller than the envelope itself. Meanwhile, the second compartment, located directly behind the first compartment is available for accepting other mailing matter that might be larger than the pre-addressed item. In contrast with other envelopes of the same or a similar type, the construction of the present invention is able to handle bulky items with greater ease. The latter feature is achieved by utilizing an end flap of the envelope as the means for dividing the envelope into two compartments and also as the document locking means for the first compartment.

In another enbodiment of the present invention for use in combining both first and third class matter in the same envelope, one of the end flaps is left unglued to permit postal inspection. In this embodiment, the first end flap retains its document locking function to thereby incorporate the generally desirable features of the first embodiment in the second embodiment. Moreover, in yet other embodiments, the end closure flaps are each of an elongated construction to better define the window compartment and separate it from the second or rear compartment of the envelope, and means is provided which permits independent access to the two compartments.

The present invention is accomplished with a substantially conventional envelope blank wherein the normal front and rear panels are reversed. That is, with conventional envelope blanks, the envelope closure flap is generally foldably attached to a first envelope panel, and, where windows are provided, they are generally cut from the same panel. However, in accordance with the present invention, the envelope closure flap is attached to one panel and the window is cut in another panel. Using conventional nomenclatue, the envelope closure flap may be seen to be foldably attached to the front panel and the window is cut in the rear panel. However, since the front and rear panels are reversed herein, the envelope is described hereinafter as having an envelope closure flap foldably attached to a rear panel and a window cut in a front panel. The construction described is particularly useful for stuffing pre-addressed pieces so that the address is visible through the window, since the windowed front panel is up and facing the envelope stuffer when the pre-addressed item is inserted. Moreover, the construction is advantageous where the pre-addressed item is substantially smaller than the envelope. With the prior art constructions, the envelope must be turned over to insure that the address on the pre-addressed piece is visible through the window. Meanwhile, the envelope blank of the present invention includes at least one oversized end closure flap which forms the document locking feature and which divides the envelope into two compartments.

The envelope blank is cut and scored to form a blank structure wherein the front window panel is narrower than the rear panel. In addition, depending upon the construction desired, the end closure flaps may be of different size or of equal size with at least one being elongated to divide the envelope into two front-to-back compartments. Meanwhile, the envelope closure flap is slightly oversize so that it will reach the narrow front window panel when closed. Thus, when the blank is folded into its final envelope configuration, the front window panel is lower than the rear panel and one or both elongated end closure flaps are positioned between the front window panel and the rear panel and slightly above the front panel. For closing, the envelope closing flap, front window panel and one or both elongated end closure flaps are each applied with strategically located strips of self sealing adhesive. Meanwhile, the end closure flaps are also applied with a conventional adhesive at each end for sealing the ends of the envelope. A characteristic feature of the self sealing adhesive used for closing the envelope and for forming the two compartments is that it will only adhere to itself, or to the same material when similarly gummed areas are pressed firmly one against the other. Thus, the surfaces applied with the self sealing adhesive will not adhere to any untreated surface either of the envelope or anything placed in the envelope. In one embodiment, the self sealing adhesive strip on the envelope closure flap is applied with sufficient width to overlap both of the similar adhesive strips applied to an oversized end closure flap and the front wall window panel, when the closure flap is folded over. In other embodiments, the adhesive is selectively applied to the end closure flap and the elongated end closure flaps at specified areas to achieve the desired bond. Accordingly, with nothing in the envelope, and when the envelope closure flap is folded over to close the envelope, the gummed areas come into contact with one another to define one end of a first compartment, that is smaller than the exterior dimensions of the envelope, between the front window wall and one or both elongated end closure flaps, and a full size second compartment between the end closure flaps and the rear panel. Further, when a preaddressed document that is smaller than the envelope is inserted in the first or front compartment, the adhesive areas applied to the folded over closure flap and an elongated end closure come together to effectively lock a document in position so that the preprinted address thereon remains under the window portion of the envelope. Meanwhile, the remaining matter inserted in the envelope can be of the same or a different size as compared with the preaddressed item, but no larger than the overall dimensions of the envelope itself. In the case of the embodiment for both first and third class mail, one of the end closure flaps remains unadhered to the front panel and/or the rear panel so that it can be opened for postal inspection of the contents when desired. It will also be noted that one embodiment includes a tear line in the envelope closure flap which enables independent access to the window or first class compartment.

DETAILED DESCRIPTION

In the above described drawings there is illustrated several embodiments of the present invention which include features that may be interchangeable. Moreover, it is to be understood that other changes and modifications may be made within the spirit of the invention as defined in the appended claims.

Figure 1:
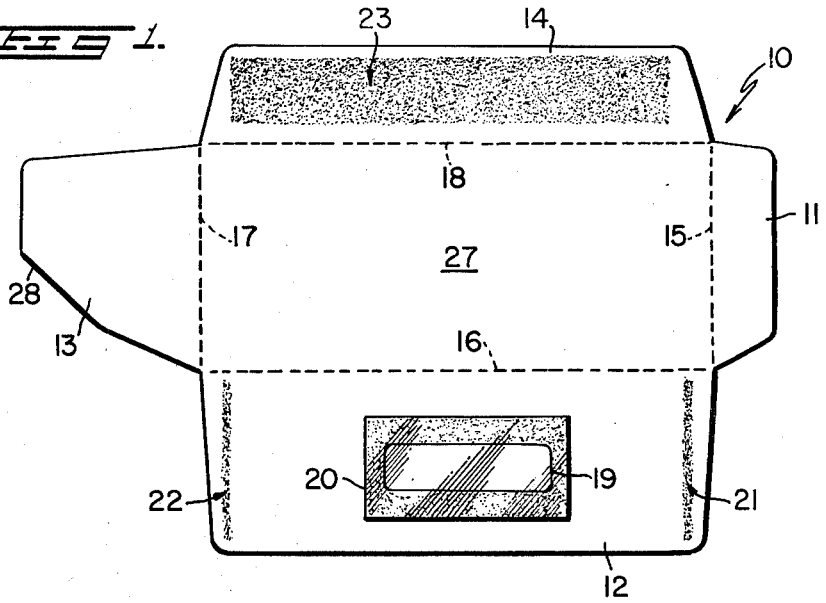
FIG. 1 illustrates in plan the inside surface of an unfolded blank for forming the envelope of the present invention.

Referring now to FIG. 1, it will be seen that the blank 10 from which the envelopes are prepared is of substantially conventional form except for the provision of an oversized, elongated end closure flap 13. The rear panel 27 has attached thereto a first normal sized end closure flap 11 along fold line 15, a front wall 12 along fold line 16, the elongated end closure flap 13 along fold line 17 and an envelope closure flap 14 along fold line 18. Front panel 12 includes a window opening 19 covered with a transparent film 20. As stated hereinbefore, the front panel 12 of the envelope of the present invention corresponds to the nominal rear panel of a conventional envelope. However, by rearranging the panels herein, applicant achieves the desirable feature whereby the windowed panel is visible to the envelope stuffer when a preaddressed item is stuffed into the envelope. This feature allows the envelope stuffer to precisely locate the address beneath the window of the envelope. Front panel 12 also has applied thereto strips of adhesive 21,22 which serve to close the ends of the envelope. It will be understood, however, that the adhesive strips 21,22 could be applied to the end closure flaps as desired. The type of adhesive applied at 21,22 is of a conventional type that will permit the front panel to be adhered to the end closure flaps 11,13. In addition, front flap 12 has applied to the front side thereof, near its free edge, a strip of self sealing gum adhesive 25. This adhesive has the characteristic that it will only stick to itself or the same material applied to a different panel.

Figure 2:
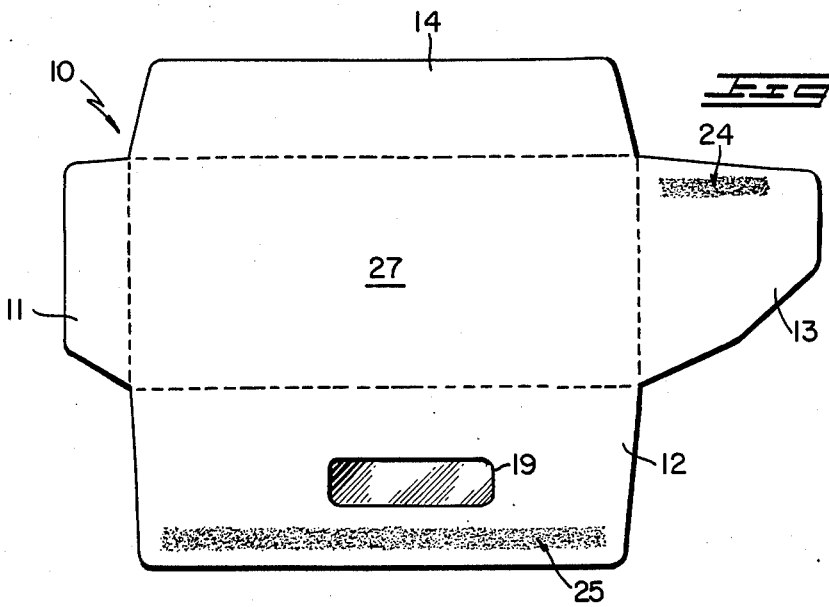
FIG. 2 is a view substantially as described for FIG. 1 showing the outside surface of the unfolded envelope blank.
Figure 3:
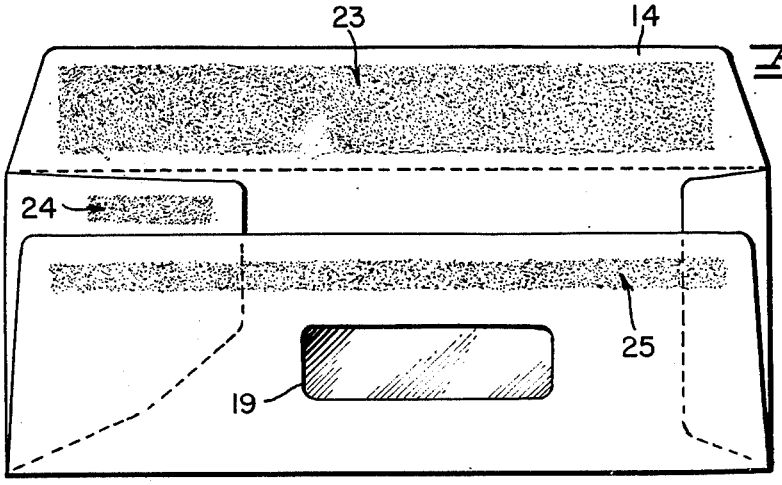
FIG. 3 shows the envelope of the present invention with its end closures sealed and ready for use.
Figure 4:
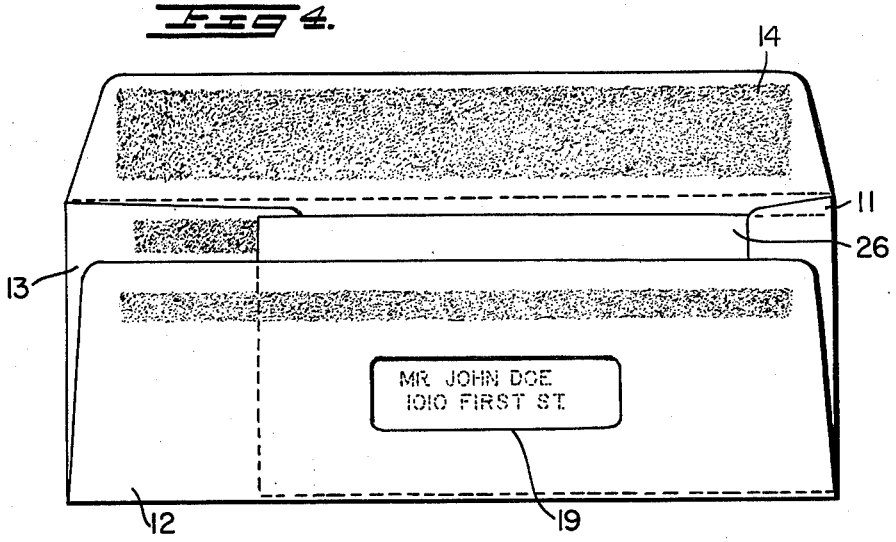
FIG. 4 shows the envelope with a preaddressed item inserted in the first compartment.
Figure 5:
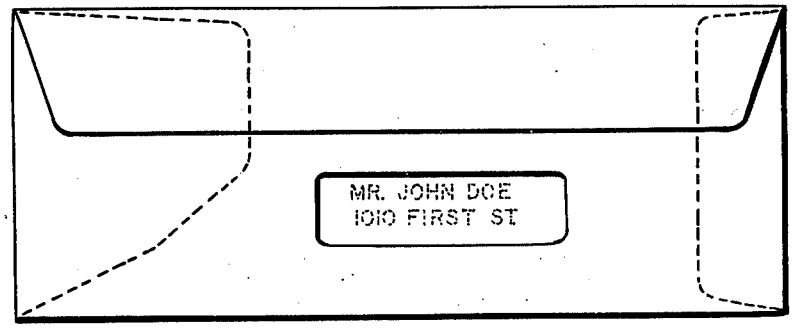
FIG. 5 shows the envelope in sealed condition with the preaddressed item locked in the first compartment.

Elongated flap 13 is illustrated as being tapered along one edge 28, but such a configuration is not required for the present invention. The only requirement is that the flap 13 extend inside the envelope a distance sufficient to divide the envelope into two compartments front-to-back. As shown in FIG. 2, the flap 13 has applied to the front side thereof a patch of gummed adhesive 24 of the self sealing type. The adhesive strip 24 is adapted to cooperate with a similar strip of self sealing adhesive 23 applied to the inside of the envelope closure flap 14 when the envelope is closed. When the two patches of self sealing adhesive 23,24 are adhered to one another, they define one end of a first front compartment in the envelope which thus has an effective size that is smaller than the overall dimensions of the envelope itself. Further, where the item 26 placed in the compartment overlaps the gummed area 24 as shown in FIG. 4, the envelope closure flap 14 tends to lock the item 26 in position when the envelope is closed. Thus when preaddressed items are inserted in the window compartment, the document locking feature effectively prevents any displacement of the preaddressed item from its intended position beneath the window 19.

Figure 6:
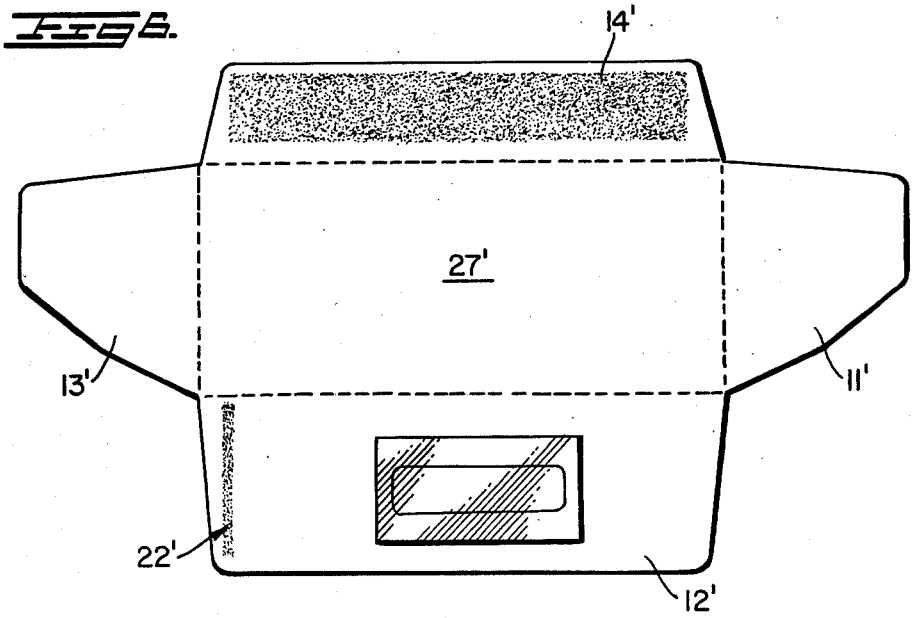
FIG. 6 illustrates a modified blank construction of the present invention for use in combining both first and third class mail.
Figure 7:
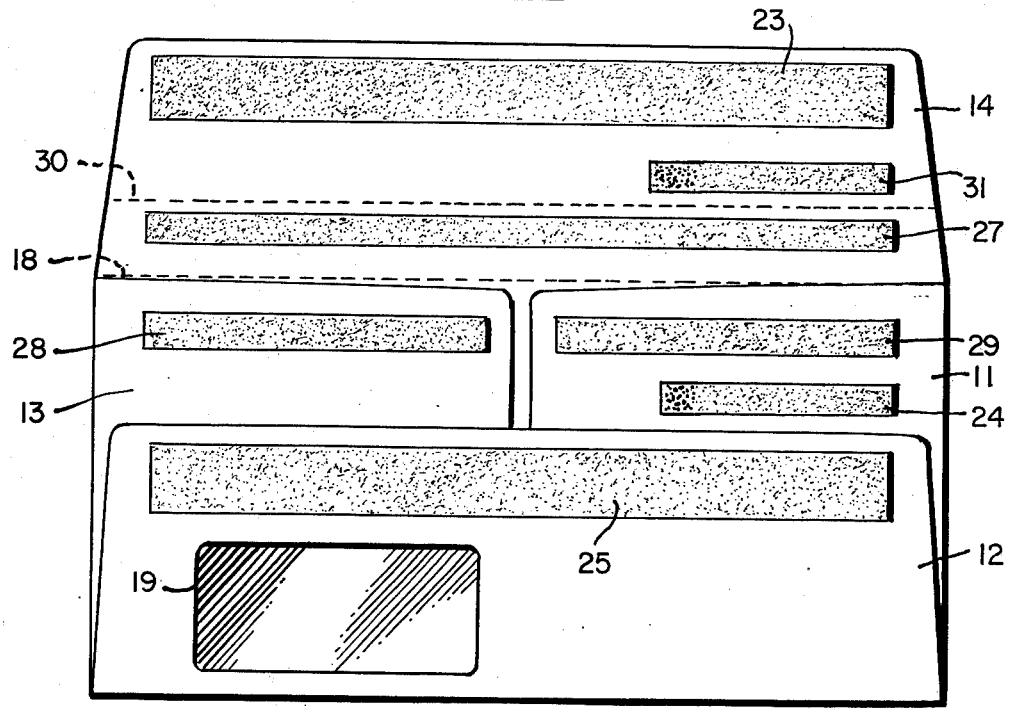
FIG. 7 shows a second modified construction of the envelope ready for use.
Figure 8:
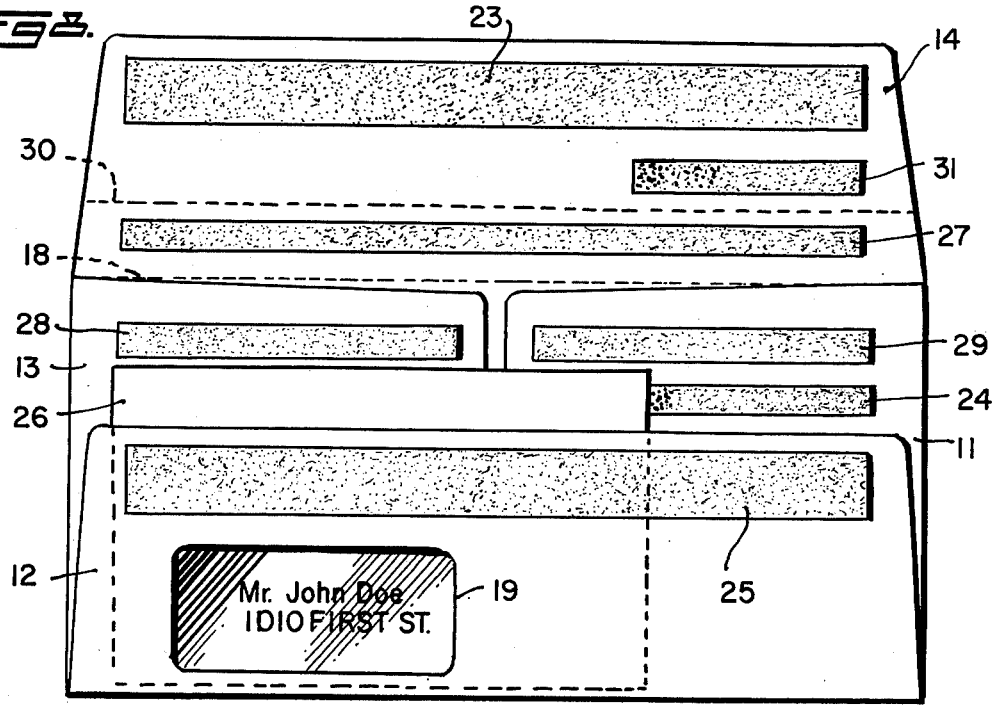
FIG. 8 shows the envelope of FIG. 7 with a preaddressed item inserted in the first compartment.

FIG. 6 shows the inside surface of a typical blank for use in making a modified envelope of the present invention. The blank will be seen to include a pair of equally sized end closure flaps 11' and 13'. In each case, the flaps 11' and 13' are elongated. As in the embodiment of FIGS. 1–5, flap 13' is adhered via adhesive 22' to the front panel 12' and thus forms the divider between the two compartments of the envelope. Meanwhile, as opposed to the previous embodiment, flap 11' is both elongated and unsecured to the front panel 12' to yield a flap that can be opened for postal inspection purposes where desired. Accordingly, the embodiment shown in FIG. 6 is capable of enclosing both first and third class matter in the same envelope. Meanwhile, FIGS. 7 and 8 illustrate yet another embodiment of the present invention wherein both end closure flaps 11 and 13 are elongated but not overlapped to form the two compartments for the envelope. In the case of the latter embodiment, separate adhesive patches 23 and 27 are applied to the closure flap 14 to mate respectively with the adhesive patches 25 and 28,29 on front flap 12 and the elongated end closure flaps 11,13. In addition, a separate adhesive patch 31 is applied to the closure flap 14 which mates with the adhesive patch 24 on flap 11 when the envelope is closed. The latter two adhesive patches serve to define one end of the front or window compartment of the envelope and simultaneously lock an item is shorter than the envelope in the window compartment. In this manner, the envelope illustrated in FIGS. 7 and 8 accomplishes the same purpose as the envelope construction shown in FIGS. 1–6. Moreover, the embodiment of FIGS. 7,8 also includes a perforated tear line 30 that permits independent access to the window compartment.

It will thus be seen that the envelope of the present invention incorporates therein several unique features. By placing the window in a first panel and the envelope closure flap on another panel, the panel to which the flap is attached is free of seams so that return addresses or other indicia can be readily applied without difficulty. Moreover, the same arrangement enables the envelope stuffer to have the window in view when the envelope is stuffed. Finally, the envelope as shown and described is also readily adapted to economical automatic machine production, stuffing and sealing with the convenience of only one closure flap for sealing both compartments.

I claim:

1. A compartmented envelope formed from a single blank of envelope material and including at least one integral panel for dividing the envelope into compartments consisting of a window compartment that is smaller in length and width than the exterior dimensions of the envelope and a second full sized compartment in front-to-back relation comprising, an elongated rear panel having two long edges and two shorter edges, a front window panel foldably attached to one of the long edges of said rear panel, a sealing flap foldably attached to the other long edge of said rear panel and a first end closue flap foldably attached to one of the shorter edges of said rear panel, the improvement comprising:

(a) a second end closure flap foldably attached to the opposed shorter edge of said rear panel, said second end closure flap being of a length sufficient to divide the envelope into its two compartments but not long enough to overlap the opposite end closure flap;

(b) a first area of pressure sensitive adhesive applied to said front panel;

(c) at least one additional area of pressure sensitive adhesive applied to said sealing flap for mating with said first area to seal both compartments (d) separate adhesive areas applied to said sealing flap and to said second end closure flap which, when mated together, additionally seal the only compartment full-sized;

(e) a perforated line in said sealing flap between the adhesive areas applied thereto for permitting independent access to said window compartment; and, (f) a third area of pressure sensitive adhesive applied to said second end closure flap, all of said pressure sensitive adhesive being of the type that will only adhere to itself whereby when said sealing flap is folded to close the envelope, the third area of adhesive mates with an area of adhesive on said sealing flap flap to retain an item that is smaller in length than said envelope in position in the window compartment of said envelope.

2. The envelope of claim 1 wherein said first end closure and said second end closure flap are of substantially the same length and together they divide the envelope into its two compartments.

3. The envelope of claim 2 wherein separate areas of adhesive are applied to both said first and second end closure flaps for sealing the window compartment.

4. The envelope of claim 3 wherein there is at least two additional areas of pressure sensitive adhesive applied to said sealing flap.

* * * * *